United States Patent [19]

Fromson

[11] 4,407,240

[45] Oct. 4, 1983

[54] OPPOSED PISTON INTERNAL COMBUSTION ENGINE WITH SPECIAL SCAVENGING MEANS

[76] Inventor: Bertram W. Fromson, Maison Des Landes S.B., Jersey, Channel Islands

[21] Appl. No.: 199,726

[22] PCT Filed: Jan. 25, 1980

[86] PCT No.: PCT/GB80/00016

§ 371 Date: Sep. 19, 1980

§ 102(e) Date: Sep. 19, 1980

[87] PCT Pub. No.: WO80/01588

PCT Pub. Date: Aug. 7, 1980

[30] Foreign Application Priority Data

Feb. 3, 1979 [GB] United Kingdom ..... 7903864
Jul. 2, 1979 [GB] United Kingdom ..... 7922896

[51] Int. Cl.[3] ..... F02B 75/24; F02B 75/28

[52] U.S. Cl. ..... 123/56 BC; 123/57 B; 123/61 R; 123/66

[58] Field of Search ..... 123/56 R, 56 B, 56 BC, 123/57 R, 57 B, 69 V, 70 V, 71 V, 61 V, 61 R, 62, 66, 65 VB, 74 AA

[56] References Cited

U.S. PATENT DOCUMENTS

| | | | |
|---|---|---|---|
| 1,230,219 | 6/1917 | Reall | 123/57 B |
| 1,316,437 | 9/1919 | Flood | 123/56 BC |
| 1,753,759 | 4/1930 | Stalker | 123/65 VB |
| 2,127,052 | 8/1938 | Koch | 123/65 VB |
| 2,392,052 | 1/1946 | Matheisel | 123/57 R |
| 3,559,628 | 2/1971 | Boldery | 123/61 R |
| 3,786,790 | 1/1974 | Plevyak | 123/57 B |

FOREIGN PATENT DOCUMENTS

| | | | |
|---|---|---|---|
| 277068 | 9/1913 | Fed. Rep. of Germany | 123/66 |
| 429505 | 9/1911 | France | 123/66 |

*Primary Examiner*—Craig R. Feinberg
*Attorney, Agent, or Firm*—Murray Schaffer

[57] ABSTRACT

A reciprocating piston machine comprising a main piston secured to a piston rod, a cylinder in which the main piston can slide, the main piston and cylinder defining a combustion chamber, a scavenging plate disposed in the combustion chamber and axially movable therein to expel combustion gases from the chamber, at least one subsidiary piston fixed on the piston rod below the main piston and slidable in a cylinder defining pumping chambers by means of which gas can be forced into the combustion chamber above the main piston at superatmospheric pressure, the arrangement being such that movement of the scavenging plate away from the cylinder head is by means of the compressed gas which then forms the fresh charge for introduction into the combustion chamber, the scavenging plate being provided with a one-way valve through which the fresh charge passes to enter the combustion chamber proper.

14 Claims, 8 Drawing Figures

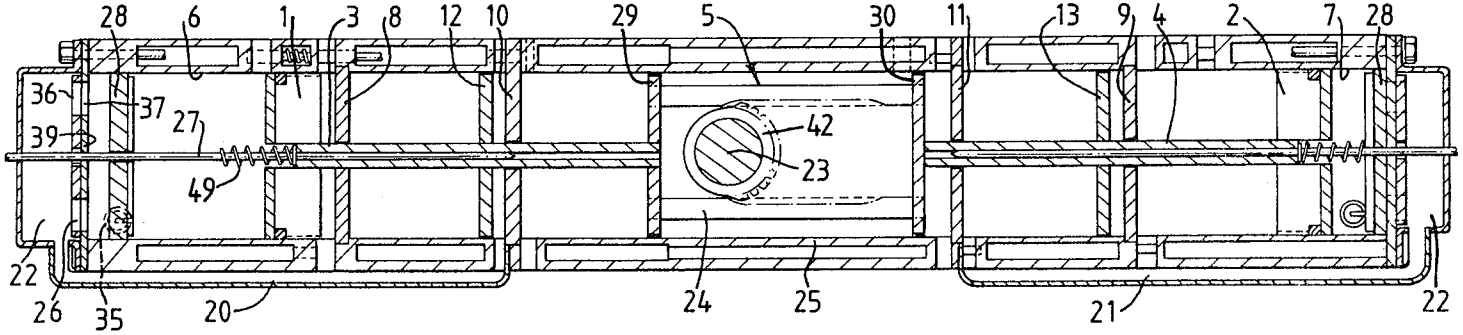
FIG. 3
FIG. 4
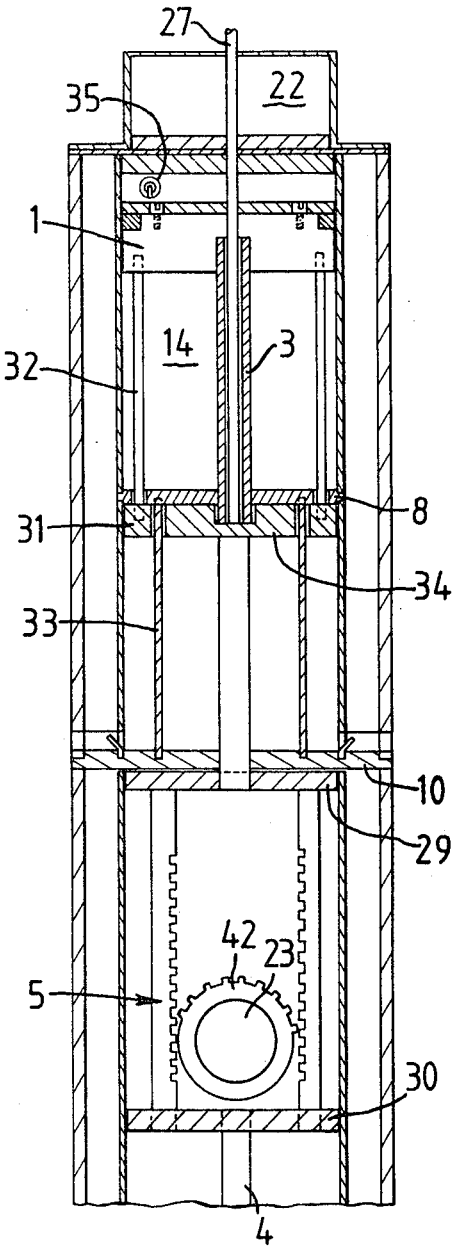

OPPOSED PISTON INTERNAL COMBUSTION ENGINE WITH SPECIAL SCAVENGING MEANS

TECHNICAL FIELD

The invention relates to reciprocating piston machines and more particularly to reciprocating piston internal combustion engines.

BACKGROUND ART

The operational of many known reciprocating piston internal combustion engines is limited at least in part by incomplete combustion of the fuel, and a side effect of the incomplete combustion is the pollution of the atmoshpere. Furthermore the conventional coupling of piston to crankshaft via a connecting rod is inefficient due to the constantly changing crank angle during the power stroke. In additional many existing coventional reciprocating piston engines are complicated and thus expensive to produce and maintain.

DISCLOSURE OF INVENTION

From one aspect according to the invention there is provided a two stroke reciprocating piston internal combustion engine comprising a scavenging plate disposed in the combustion chamber and axially movable therein to function as a free piston to expel combustion gases therefrom. The scavenging plate is preferably arranged to be retained against the cylinder head during the power stroke of the piston and to be released for axial movement in the combustion chamber towards the end of the power stroke. The scavenging plate is preferably guided during its movement by one or more guide rods disposed in the cylinder. Movement of the scavenging plate may be achieved by means of compressed gas which may form the fresh charge for introduction into the combustion chamber. For this purpose the scavenging plate may if desired be provided with a one-way valve by means of which the fresh charge may enter the combustion chamber proper after causing movement of the plate to expel exhaust gases.

The inlet and exhaust valve of the engine are preferably piston controlled and may comprise an oscillating disc inlet valve and an axially slidable sleeve exhaust valve. Alternatively the valve may be driven by conventional means e.g. by a gear train driven from an output shaft connected to the piston. From another aspect the invention is a reciprocating piston machine comprising a main piston secured to a piston rod and one or more subsidiary pistons fixed on the piston rod below the main piston and by means of which gas can be forced into a combustion space above the main piston at super-atmospheric pressure. Preferably the sub-pistons slide in the same cylinder as the main piston. One or more of the sub-pistons may be arranged to pump a liquid, e.g. hydraulic oil, in which case it may be desirable for the swept volume of the liquid pumping cylinder to be relatively small. This can be achieved if desired by arranging the liquid pumping cylinder to be of relatively small swept volume as compared with the volume swept by the main piston, e.g. by being of small diameter or by being an annular cylinder surrounding a gas pumping cylinder. Alternatively the piston of the liquid pumping cylinder could be connected to the piston rod by means of a lost motion coupling to reduce the effective stroke of that particular subsidiary piston.

The piston rod may be connected to a conventional crank shaft by means of a connecting rod but preferably the piston rod is connected to drive an output shaft by means of a so-called sector pinion device comprising a toothed forked member and a pinion having teeth over half of its periphery. In an alternative arrangement the sector pinion device could be replaced by a similar, mechanically equivalent device in which the meshing teeth are replaced by smooth faces which engage frictionally one with the other. In this arrangement the sector pinion itself may be replaced by a frusto-conical wheel half of the peripheral surface of which is faced with a friction material, while the forked member is provided with two inclined smooth faces arranged to be engaged alternately by the friction face of the frusto-conical wheel. To compensate automatically for wear the wheel is preferably splined on its shaft so that it can move axially thereon and is urged by resilient means such as a spring into engagement with the inclined faces of the forked member. Since it is preferred to extract power from the engine mainly by way of the hydraulic pumping action driving an hydraulic motor and or by means of a turbine or other device driven by compressed gas produced in one or more of the subsidiary gas pumping cylinders it is not necessary for the sector pinion device to be able to withstand the full power output of the engine. It is thus possible for the sector pinion device to be of light construction and preferably the mating teeth of the device are of reinforced elastomer such as synthetic rubber in the interests of quiet running. Preferably the output shaft carries a light flywheel which may if desired be used to drive the ignition system of the engine, where appropriate, and which preferably carries gearing by means of which a starter motor can be connected to the engine.

BRIEF DESCRIPTION OF DRAWINGS

Embodiments of the invention are diagrammatically illustrated, by way of example, in the accompanying drawings, in which:

FIGS. 2 and 3 are views similar to FIG. 1 but show the pistons in the two end positions respectively, FIG. 4 is a scrap view similar to that of FIG. 1 of an alternative form of engine.

BEST MODE OF CARRYING OUT THE INVENTION

Figure 1:
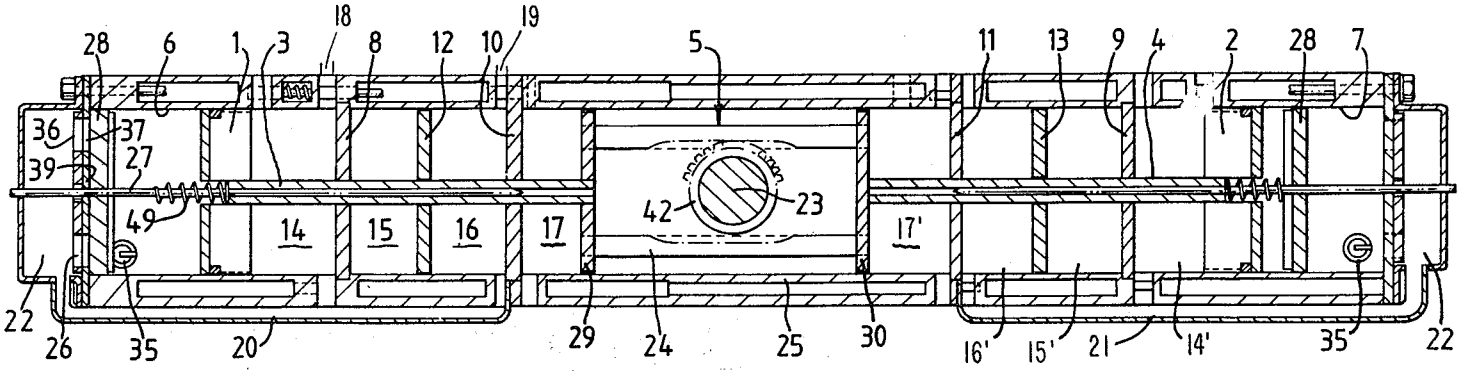
FIG. 1 is a cross-sectional side view of a horizontally opposed reciprocating piston two stroke internal combustion engine showing the pistons in an intermediate position.
Figure 2:
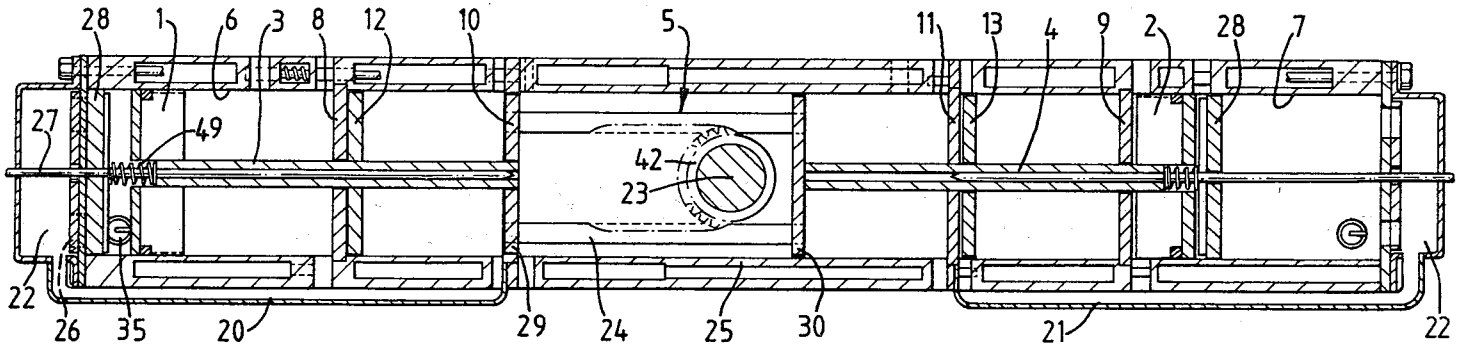

In FIGS. 1 to 3 of the drawings there is shown a horizontally opposed two stroke reciprocating piston internal combustion engine which is symmetrical about a central shaft 23. The engine comprises a double-walled cylindrical body in which slide an opposed pair of main pistons 1 and 2 respectively secured to the ends of co-axial tubular piston rods 3 and 4 respectively, which are rigidly connected together by a sector pinion device 5, described more fully below, such that when one piston is at the top of its stroke the other piston is at the bottom of its stroke and vice versa. The pistons slide in co-axial cylinders 6 and 7 respectively and two fixed partitions 8 and 10 and 11 respectively are provided in each cylinder under each main piston so that in addition to the combustion chamber four further cylindrical spaces 14, 15, 16, 17 and 14', 15', 16' and 17' respectively are associated with each piston and each of which operates as a pumping cavity with the aid of the under surface of the main piston and disc-like pistons 12, 13 secured to the respective piston rods. In addition the opposite ends of the sector pinion device 5 are formed as pistons 29 and 30. It will, of course, be appreciated that it would be possible readily to increase or decrease the number of pumping cavities. In this embodiment the chamber immediately under the main piston and the adjacent chamber are arranged to accept fuel or a gas from a carburetor or the like via inlets 18 and 19 at atmoshperic pressure and to transfer the mixture via a transfer passages 20, 17' respectively to an intermediate chamber 22 arranged above the cylinder head, for introduction into the combustion chamber in the manner described below. Since the fuel mixture is delivered to the chamber 22 from a plurality of pumping chambers each of which is equal in capacity to the volume swept by the main piston, such an arrangement provides a super-charged engine in a simple manner. The pumping chambers 17 and 21 which in this embodiment are disposed remotely from the combustion chamber are arranged to pump hydraulic fluid which may be used to power any desired hydraulic device e.g. an hydraulic motor to drive the wheels and/or the power steering of a motor vehicle. In addition power may be extracted from the engine via an appliance such as a turbine driven by the pumped gases. In either case it may be desirable to smooth the power-impulses with the aid of an hydraulic accumulator (not shown) or the like. Power may also be extracted from the engine and the piston motion controlled via the sector pinion device 5 which comprises a pinion 42 secured to a shaft 23 and toothed around half of its periphery, the pinion being arranged to engage alternately the opposed portions of a toothed fork-like member 24. Such a mechanical device may also be used to couple together two or more pairs of the pistons for synchronised movement and to carry a flywheel. Preferably most of the power from the engine is extracted via the pumped fluid rather than via the shat 23. In the drawings the piston rods are rigidly connected to a common forked toothed member 24 which drivingly engages a sector pinion 42 which in turn carries a flywheel (not shown). The sector pinion is disposed in a central cavitity 25.

Reference numeral 35 designates a spark plug. The ignition timing mechanism may be of standard type but preferably is of the contactless electronics variety. It may be housed in the sector pinion cavity. Alternatively the ignition system could be taken from suitable pick-ups on the flywheel. Also the engine may be operated as a diesel without spark plug, having air pumped from chambers 14 and 17 (14' and 17') and fuel introduced directly into the combustion chamber 6 (7) at the appropriate time for ignition.

Figure 8:
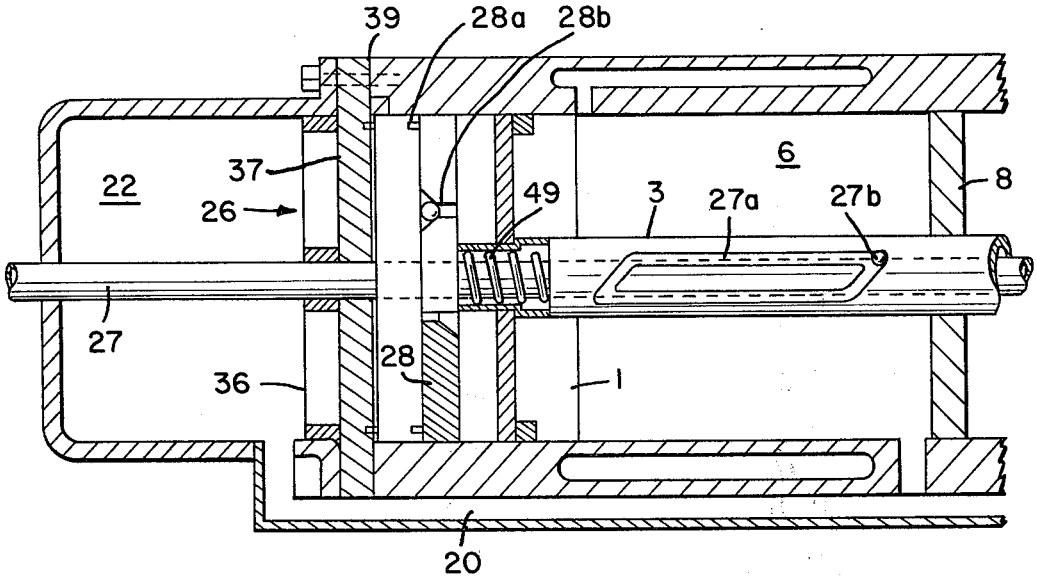

An inlet valve 26, by means of which the compressed gas from the intermediate chamber 22 above the cylinder head is introduced into the combustion chamber, comprises an oscillating disc formed with apertures 36 which on rotation of the disc align with corresponding apertures 37 in a fixed plate 39 forming the cylinder head. Oscillating movement of the valve disc is provided by means of a rod 27 secured to the centre of the disc and which extends through the combustion chamber and is slidingly carried in the piston rod 3 which in turn is formed as seen in FIG. 8 with a cam track **27*a* in which a projection 27*b* in the rod 27** engages so that axial movement of the piston rod causes oscillating rotation of the disc through, for example, 45°.

A scavenging plate 28 is held against the cylinder head by means of releasable catches **28*a* (FIG. 8) which are actuated by the main piston 1 near to the bottom of its power stroke so that when the inlet valve 26 is opened the scavenging plate is forced downwards in the cylinder by the flow of compressed gas from the intermediate chamber 22 to the chamber 6. In so doing the scavenging plate 28 acts as a free piston to expel the remaining exhaust gases from the combustion chamber 6. When the main piston 1 begins its compression stroke the inlet valve 26 closes and the scavenging plate 28 is carried upwards with the piston and is forced away therefrom and towards the cylinder head by resilient means e.g. a coil spring 49 provided on the piston whereby the fresh gas mixture may come into direct contact with the piston crown via apertures provided in the scavenging plate 28. The resilient means also ensures that the scavenging plate is pressed against the cylinder head at the end of the compression stroke so that it is latched back into a fixed position during a part of the power stroke. If desired, the movement of the scavenging plate to expel burnt gases from the cylinder may be achieved by mechanical means such as a compression or tension spring. The apertures in the scavenging plate are controlled by valves 28*b*** such as one-way valves or by projections in the head of the piston. The motion of the scavenging plate in the cylinder may be controlled by any suitable means such for example one or more guide rods.

Since in the present embodiment the piston rod does not drive a normal crank mechanism there is no tendency for the cylinders to wear oval nor is power lost by the crank mechanism itself although of course the advantages of the invention as regards the positive scavenging of the cylinder may be applied to a conventional engine in which the pistons are connected to a crankshaft by means of connecting rods. In this case the rod can pass centrally through the piston head using two connecting rods or a single forked piston rod, the rod passing between two half gudgeon pins in the piston.

In an alternative embodiment particularly applicable to four stroke engines the scavenging plate may be secured for limited axial movement to the top of the piston head by light compression springs or other resilient means which on the scavenging stroke of the piston will extend to expel the residue of the burnt gases entrapped in the space still left following the latter stroke. The scavenging plate will be pressed back against the head of the piston on the succeeding compression and power strokes, since the resiliency of the springs need only be fairly light for the final expulsion purpose. If desired buffers such as springs or resilient heat resisting inserts may be provided in the cylinders or in the pistons to cushion the pistons towards the ends of their travel and eliminate noise.

The exhaust valve from the combustion chamber and the inlet and exhaust valves from the subordinate chambers are sleeve valves which are normally biased closed by means of springs and which are actuated by means of projections which engage the underside of the piston on movement thereof to open the valves.

It is envisaged that in practice a four (or more) cylinder engine may be produced which couples together two pairs of the opposed pistons via a sector pinion and a light flywheel. Preferably the pairs of pistons would be coupled to operate in opposite directions so as to balance the engine. Alternatively where space is restricted, a single cylinder may be utilised or a parallel twin configuration may be employed, the pistons being coupled together e.g. by a sector pinion as described above on a common shaft.

If desired the capacity of the hydraulic pumps can be varied by means of lost motion couplings between the main piston and the piston controlling the hydraulic chamber or by adjustable entry valves. Alternatively the arrangement shown in FIG. 4 could be employed. In this embodiment which is generally similar to that described above the main piston is connected by means of rod 32 to an annular piston 31 slidable in an annular cylinder 33 surrounding a subsidiary pumping cylinder comprising a piston 34 secured to the rod 3. The swept volume of the annular cylinder is thus relativey small. The annular chamber could if desired be divided into a plurality of separate chambers with the aid of axially extending partitions, in which case the annular piston will also require division into separate sections each of which is connected to the main piston by its own rod. Each of the separate chambers will preferably have an individually controlled outlet valve so that the range of operation of the device is extended.

It will be seen in FIG. 4 that the member 27 has been lengthened as compared with the corresponding part in FIGS. 1 to 3 so that it extends from the engine through the wall of the intermediate chamber 22. This is done for the purposes of lubrication and to this end the member 27 is formed hollow so that a lubricant can be fed to all of the moving parts of the engine.

Figure 5:
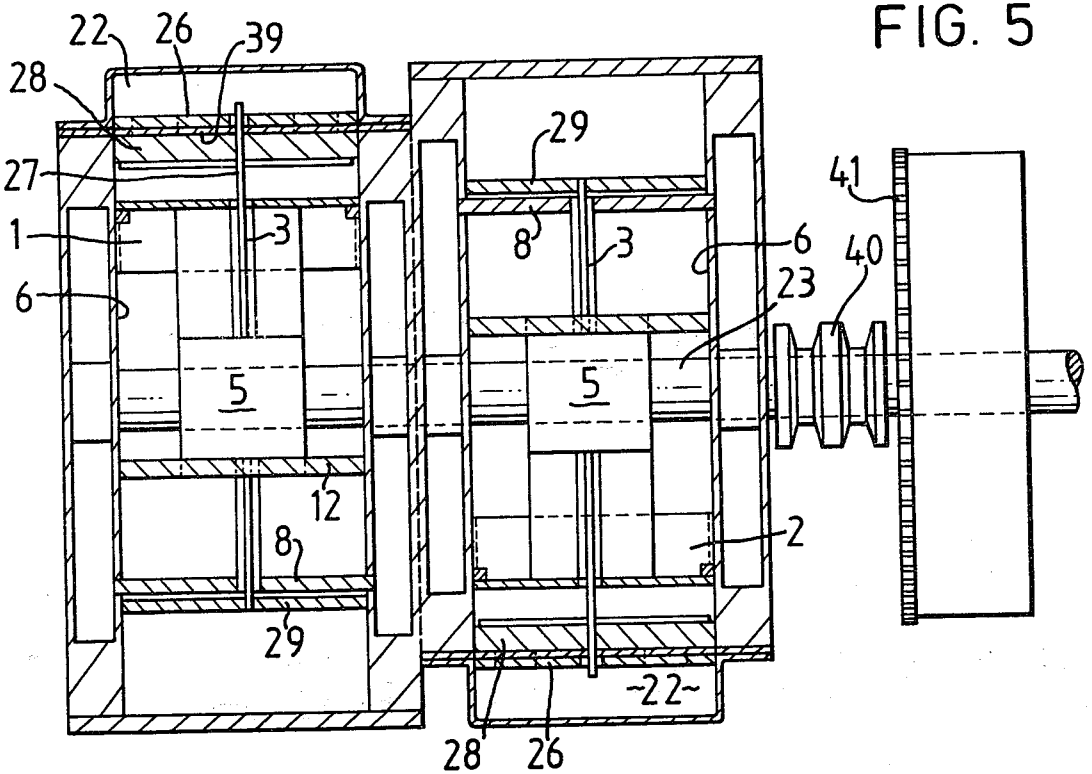
FIG. 5 is a sectional side view of a further embodiment of engine.

In FIG. 5 of the drawings an internal combustion engine of the kind generally described above comprises a parallel pair of cylinders 6 coupled together to produce a compact engine. As it will be seen the sector pinion device 5 is disposed immediately below the main piston 1 and the subsidiary pistons 12 and 29 are disposed on the side of the sector pinion remote from the main piston. The sector pinion devices drive a common shaft 23 whch carries a pulley 40 for a Vee belt and a fly wheel 41 which is toothed round its periphery so that it can be driven by a starter motor.

Figure 6:
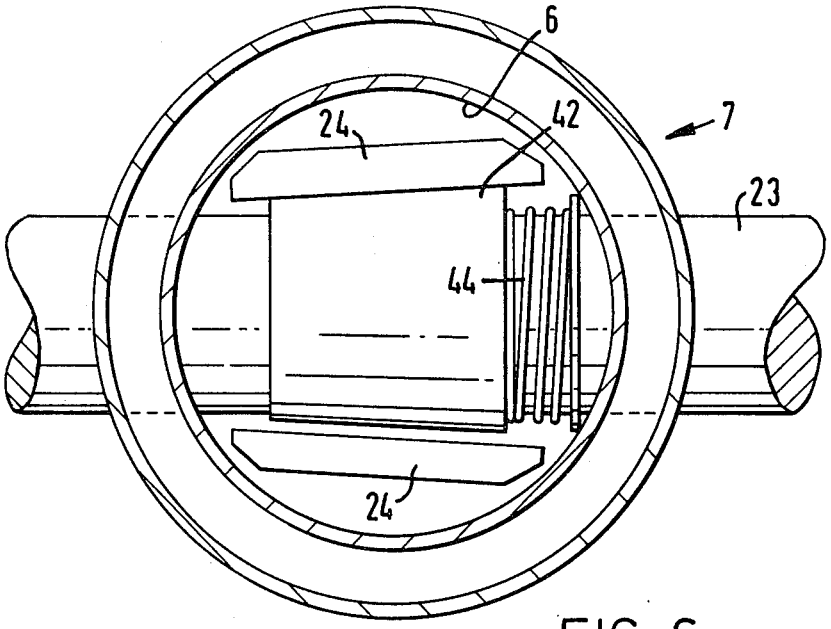
FIG. 6 is a section through a modified form of sector pinion device for connecting the piston rod to an output shaft.
Figure 7:
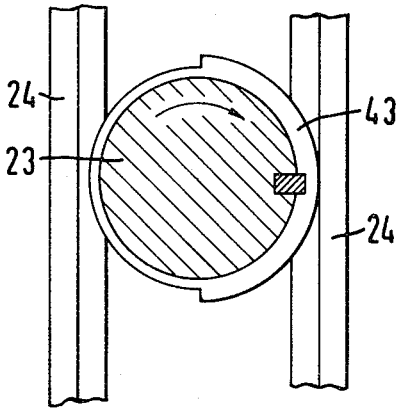
FIG. 7 is a view in the direction of the arrow 7 of FIG. 6 and, FIG. 8 is an enlarged view, partially in section, of the combustion chamber, shown in FIG. 1.

In FIGS. 6 and 7 there is shown a modified form of the sector pinion device 5 shown in the previous Figs. and in which the toothed engagement is replaced by frictional engagement. The pinion 42 is in the form of a frusto-conical member which is keyed on the shaft 23 so that it can move axially on the shaft but is constrained for rotation with the shaft. The member 42 is provided round half of its peripheral surface with a friction material 43 which, on rotation of the shaft 23 engages alternately the opposed inclined faces of the forked member 24. The member 42 is urged along the shaft by a compression spring 44 so as to compensate automatically for wear and ensure that the friction material 43 of the member 42 remains in contact with the faces of the forked member 24.

INDUSTRIAL APPLICABILITY

It will be seen from the drawings that the engine in accordance with the invention is relatively simple to produce in that it does not require intricate castings or machined parts and instead comprises a number of tubular cylinder-forming sections which are easily produced and which are bolted together by means of tie rods so as to be co-axial. In this manner the production costs of the engine can be minimised and because of the few intricate moving parts adjustments and maintenance are substantially reduced.

The hydraulic power system permits the fluid to be conveyed in tubes which may be rigid or flexible and is therefore easily distributed to wheels or power points thus eliminating in the case of a vehicle for example the mechanical means now used such as gears, propeller shaft transmission and differential gears.

In view of the several pumping chambers driven by each piston it is also envisaged that the engine could be used as a self-propelled compressor of air, gas or vapour.

Furthermore the several features embodied in this invention may be applied to an engine where the power does not derive from the process of combustion within the engine but from a gas under high pressure.

I claim:

1. A reciprocating piston machine comprising a cylinder having a head at one end, a closing wall at the other end and a fixed partition therebetween defining a first pumping chamber with the closing wall, at least one main piston slidably mounted between the partition and the cylinder head and defining a combustion chamber with the cylinder head and a second pumping chamber with the fixed partition, a piston rod secured to said main piston and extending through said partition, at least one subsidiary piston secured to said piston rod within said first pumping chamber and slidable relative thereto conjointly with the movement of said main piston, said main piston having a compression stroke on movement toward said head and a power stroke on movement toward said closing wall said subsidiary piston having a compression stroke conjointly with the power stroke of said main piston, a scavenging piston freely disposed in the combustion chamber about at least one guide rod between the cylinder head and the main piston, said scavenging piston being in axial slidable engagement with said guide rod and the walls of said cylinder, means located about said guide rod for normally biasing said scavenging piston toward said cylinder head said at least one guide rod extending axially through said cylinder head, means for supplying a charge to said first and second pumping chambers for compression therein, conduit means from said pumping chambers to said combustion chamber for introducing the compressed charge into said combustion chamber between the cylinder head and the scavenging plate on the power stroke of said main piston, said compressed charge driving said scavenging plate toward the main piston to scavenge combustion products from the combustion chamber and allow said combustion chamber to fill with compressed charge, said scavenging plate having valve means permitting return of the scavenging plate through the compressed charge in the combustion chamber on the compression stroke of said main piston.

2. A reciprocating piston machine according to claim 1, wherein the machine is a two stroke internal combustion engine, the charge comprises a fuel, and a spark ignition means is provided in said combustion chamber.

3. A reciprocating piston machine according to claim 1, comprising an opposed pair of main pistons secured to opposite ends of coupled piston rods.

4. A reciprocating piston machine according to claim 1, wherein the piston rod is connected to drive an output shaft by means of a sector pinion.

5. A reciprocating piston machine according to claim 4, wherein the mating teeth of the sector pinion are resilient.

6. A reciprocating piston machine according to claim 1, comprising means for retaining the scavenging piston against the cylinder head during at least part of the power stroke of the main piston.

7. A reciprocating piston machine according to claim 6, wherein the retaining means for the scavenging piston comprises releasable catches which are actuated by movement of the main piston.

8. A reciprocating piston machine according to claim 1 wherein said cylinder and piston rod extends beyond said end wall, and a sub-piston is mounted on said piston rod within said extension, said sub-piston defining with said cylinder a sub-chamber for pumping for pumping action of a fluid, having inlet and outlet means for said fluid.

9. A reciprocating piston machine according to claim 8 wherein swept volume of the fluid pumping sub-chamber is relatively small as compared with that of the main combustion chamber.

10. A reciprocating piston machine according to claim 1, comprising piston controlled inlet and exhaust valves.

11. A reciprocating piston machine according to claim 10, comprising an axially slidable sleeve exhaust valve.

12. A reciprocating piston machine according to claim 10, wherein said inlet valve comprises an oscillating disc inlet valve.

13. A reciprocating piston machine according to claim 12, wherein said at least one guide rod extends axially from said piston and the oscillating disc inlet valve is mounted for rotation on said guide rod, a said guide rod engaging a cam track on the piston rod so that reciprocation of the piston rod causes oscillating rotation of the inlet valve disc.

14. A reciprocating piston machine according to claim 13, wherein the rod on which the inlet valve disc is mounted is hollow and has one end projecting outside the engine, whereby lubricant can be fed to the moving parts of the machine.

* * * * *